United States Patent [19]

Taylor

[11] 3,960,466

[45] June 1, 1976

[54] DOUCHE-ENEMA PUMP

[76] Inventor: Edward J. Taylor, 201 Pecan Grove Court, San Jose, Calif. 95123

[22] Filed: Feb. 10, 1975

[21] Appl. No.: 548,676

[52] U.S. Cl. ..... 417/234; 128/66; 417/313; 417/477

[51] Int. Cl.[2] ..... F04B 21/00; F04B 43/12

[58] Field of Search.... 417/234, 313, 412, 475–477; 128/66

[56] References Cited

UNITED STATES PATENTS

| | | | |
|---|---|---|---|
| 2,314,281 | 3/1943 | Knott | 417/477 |
| 2,694,984 | 11/1954 | Daniels | 417/477 |
| 3,116,697 | 1/1964 | Bilichniansky | 417/477 |
| 3,138,104 | 6/1964 | Cantor | 417/477 |
| 3,762,411 | 10/1973 | Lloyd et al. | 128/66 |
| 3,783,867 | 1/1974 | Summersby et al. | 128/66 |

*Primary Examiner*—Carlton R. Croyle
*Assistant Examiner*—O. T. Sessions
*Attorney, Agent, or Firm*—Phillips, Moore, Weissenberger Lempio & Strabala

[57] ABSTRACT

The invention is concerned with a peristaltic action pump useful for douche and enema purposes and capable of delivering a uniform flow of liquid. The pump comprises a flexible tube affixed in a hemicircular shape and having a fluid input port at one end thereof and a fluid exit port at the other end thereof. A rotatable member is provided adjacent to and generally parallel to the plane of the hemicircle, the rotatable member being rotatable about an axis in line with the axis of the hemicircle. Means are also provided, coupled with the rotatable member for rotatingly driving it. A pair of levers are provided pivotally mounted intermediate thereof to the rotatable member, each at an equal and non-zero distance from the rotational axis of the member, a line from the mounting of one of the pair of levers to the mounting of the other of the pair of levers passing through the rotational axis of the member. A pair of rollers are provided, one of the rollers being pivotally attached to one of the ends of each of the levers, the rollers extending sufficiently from the one ends of the levers to press upon and to temporarily deform the flexible tube, a line from the attachment of one of the pair of rollers to the attachment of the other of the pair of rollers passing generally through the rotational axis of the member. Also spring means are provided between the other ends of the pair of levers biasing said other ends of said pair of levers towards one another, a line from said other end of one of said levers to said other end of the other of said levers passing generally through said rotational axis. The pump may also include cam means for selectively lifting one of the pair of rollers away from the flexible tube whereby pulsating flow of fluid is obtained from the pump.

6 Claims, 7 Drawing Figures

DOUCHE-ENEMA PUMP

BACKGROUND OF THE INVENTION

1. Field of the Invention

The invention is concerned with a pump which is useful for douche and enema purposes. More particularly a peristaltic action pump is contemplated which provides a uniform flow of liquid due to a unique mounting of the rollers which provide the peristaltic action and which also supplies, via a unique cam arrangement, a pulsating flow of liquid.

2. Prior Art

Prior art apparatus for douche and enema purposes has generally consisted of simply a hanging vessel such as an elastomeric bag or the like from which liquid flows through tubing under the impetus of gravity. The use of such apparatus has often been highly inconvenient because of lack of suitable places for hanging the vessel, the necessity for placing the vessel high above the user thereof to obtain a sufficient hydrostatic head, the frequent requirement that the user of the bas assume an uncomfortable position because of the relatively low pressure of fluid obtainable from the gravity flow and the like.

Peristaltic action pumps are known to the prior art but not for douche and enema purposes. Typical prior art patents which show peristaltic pumps include U.S. Pat. Nos. 3,402,673; 3,726,613; 3,799,702; 3,822,948; 3,826,593; and 3,829,251. Since these prior art peristaltic pumps have not been designed to solve some of the problems and provide some of the advantages desirable in a peristaltic pump for douche and enema purposes, they have not provided, in combination, the structure of the peristaltic pump of the present invention nor its advantages.

In particular, it is desirable to provide a peristaltic action pump for douche and enema purposes which can provide either a uniform (steady) flow of fluid or alternatively, and at the user's choice, a pulsating flow of fluid. Thus, application of a pulsating flow of fluid is possible for desirable stimulation and/or cleansing while application of a slow and steady flow to sensitive tissues is likewise possible.

SUMMARY OF THE INVENTION

Briefly, the invention comprises a peristaltic action pump useful for douche and enema purposes and capable of delivering a uniform flow of fluid. The pump comprises a flexible tube affixed in a hemicircular shape and having a fluid input port at one end thereof and a fluid exit port at the other end thereof. A rotatable member is provided adjacent the tube and generally parallel to the plane of the hemicircle, the rotatable member being rotatable about an axis in line with the axis of the hemicircle and means are provided which are coupled with the rotatable member for rotatingly driving it. A pair of levers are included pivotally mounted intermediate thereof to said rotatable member, each at an equal and non-zero distance from the rotational axis of said member, a line from the mounting of one of said levers to the mounting of the other pair of said members passing through the rotational axis of the member. A pair of rollers are rotatably attached one to one of the ends of each of the levers, the rollers extending sufficiently from said one ends of said levers to press upon and temporarily deform the flexible tube, a line from the attachment of one of said rollers to the attachment of the other of said pair of rollers passing generally through the rotational axis of the member. In addition, spring means are provided between the other ends of said pair of levers biasing said other ends of said pair of levers towards one another, a line from other end of one of said levers to said other end of the other of said levers passing generally through said rotational axis.

Preferably, each of said pair of rollers includes a shaft extending from the pivotal axis thereof and beyond the tube, and the pump further includes a cam fixable in place adjacent the tube on an opposite side of said tube from said rotatable member, said shaft of at least one said rollers extending sufficiently so as to ride upon said cam when fixed in place, said cam serving to keep one of said rollers from pressing upon and temporarily deforming said flexible tube during a portion of said one of said rollers rotation about the rotational axis of said member whereby a pulsating flow of liquid can be selected by fixing said cam in place along with means for fixing said cam in place adjacent said tube and means for fixing said cam out of place away from said shaft.

BRIEF DESCRIPTION OF THE DRAWINGS

The invention will be better understood by reference to the drawings in the figures of which like numbers denote like parts throughout and wherein.

DETAILED DESCRIPTION OF THE PREFERRED EMBODIMENT

Figure 1:
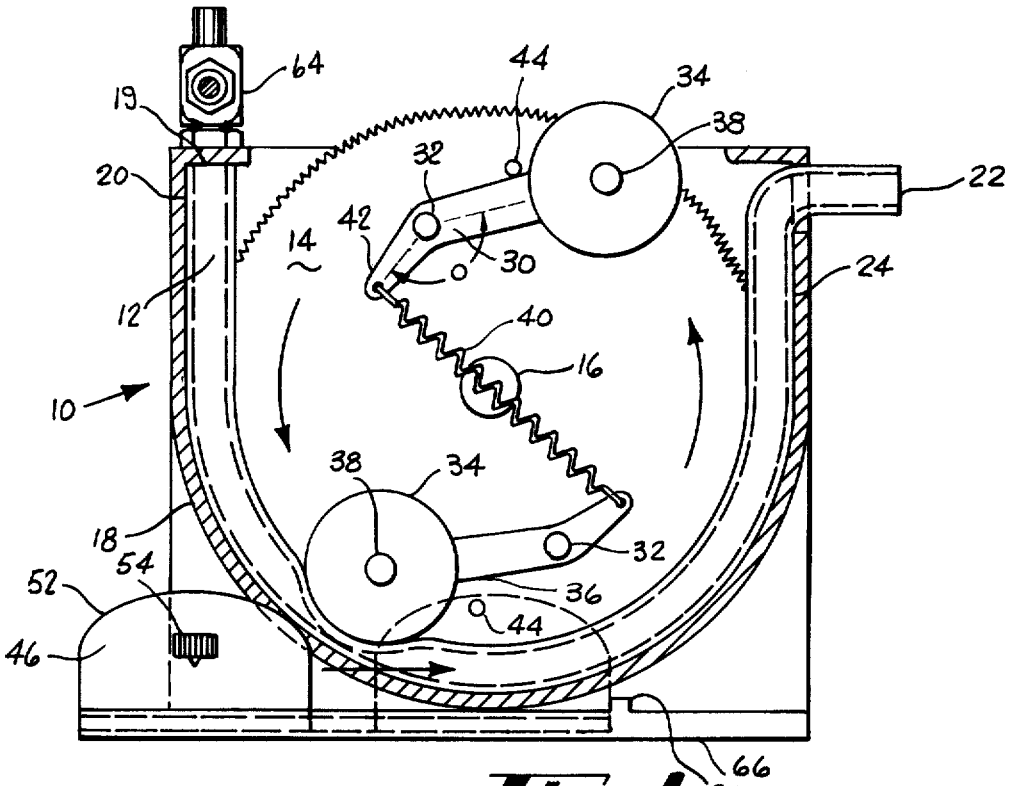
FIG. 1 illustrates in side elevation view the pump of the present invention.
Figure 2:
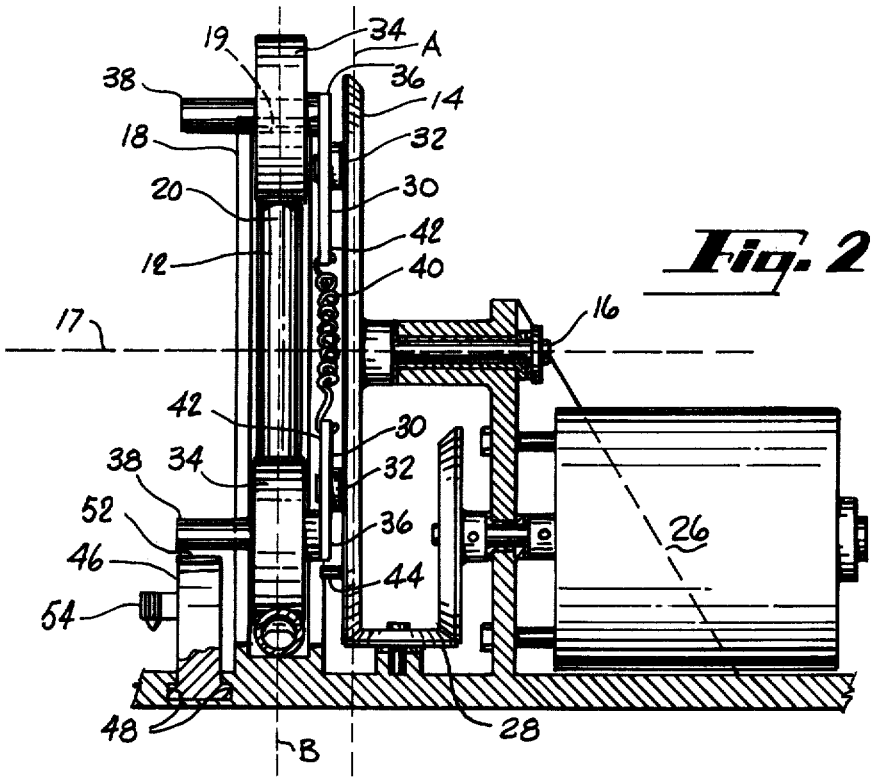
FIG. 2 illustrates the pump of the present invention in partially cut away end view.

Referring now most directly to the drawings, the invention comprises a peristaltic action pump 10 which includes a flexible tube 12 having a rotating member, in the embodiment illustrated, a rotating disc 14 which rotates about a center 16 thereof thereby defining a rotational axis 17 thereof. The disc 14 as illustrated most clearly in FIGS. 1 and 2, lies in a plane, A, parallel to the plane, B, in which the flexible tube 12 is affixed. The flexible tube 12 as will be noted from the drawings is affixed in a hemicircular shape and is supportedly backed by the hemicircular guide 18 for reasons which will be apparent in the following.

The flexible tube includes a fluid input port 19 at one end 20 thereof and a fluid exit port 22 at the other end 24 thereof. The disc 14 is rotatable about its center 16 which falls on the axis 17 in line with the axis (also 17) of the hemicircle formed by the tube 12. Means are provided coupled with the disc 14 for rotatingly driving it. The particular means provided for rotatingly driving the disc 14 comprises the electric motor 26 which drives the disc 14 in a conventional manner via the gears 28.

A pair of levers 30 are pivotally mounted intermediate their ends at a pair of pivots 32. The pivots 32 are removed from the center 16 of the disc 14 and are each on the same diameter of the disc 14. That is, a line from one of the pair of pivots 32 to the other pair of pivots 32 passes through an extension of the center 16 of the disc 14 and thus of course passes through the rotational axis 17. A pair of rollers 34 are pivotally attached to one end 36 of each of the levers 30. The pivotal attachment is at a shaft 38. The rollers 34 extend sufficiently from the one ends 36 of the levers to press upon and temporarily deform the flexible tube. A line from one of the shafts 38 to the other of the shafts 38 passes generally through the axis 17. Because one of the rollers 34 is generally displaced somewhat from its rest position through contact with the flexible tube 12, a line from one of the shafts 38 to the other of the shafts 38 will generally not exactly pass through the axis 17.

Spring means, in the embodiment illustrated the spring 40, are attached between the other ends 42 of the pair of levers 30. The spring 40 serves to bias the other ends 42 of the levers 30 towards one another.

With the levers 30 mounted to the pair of pivots 32 and the spring 40 biasing the other ends 42 of the levers 30 toward one another, a steady flow of fluid out of the exit port 22 of the flexible tube 12 results.

The disc 14 has upraised therefrom a pair of pins 44 which serve as stops for the rotation of the levers 30 about their pivots 32. The pins 44 are upraised from the disc 14 sufficiently as to stop the levers 30 from rotating about their pivots 32 beyond said pins 44. The pins 44 are upraised from the disc 14 at points thereon further removed from the center 16 of the disc 14 than are the pivots 32 of the levers 30. Further the pins 44 are upraised from the disc 14 so as to stop movement of the levers 30 intermediate the pivots 32 thereof and the shaft 38 thereon. The pins 44 serve to restrict the amount of rotation of the one end 36 of the levers 30 whereby tension results in spring 40 as one of the rollers 34 rolls along and presses upon and temporarily deforms the flexible tube 12, while the other of the levers 30 is stopped by the respective pin 44. Thereby a more uniform pressing upon the flexible tube 12 by the rollers 34 is provided.

The shafts 38 of the rollers 34 extend from the pivotal axis of the rollers 34 to beyond the tube 12. For the practice of the present invention, it is necessary that at least one of the shafts 38 so extend and generally both of the shafts 38 will so extend. The extending shafts 38 coact with a cam 46 which slides in a slot 48. A cam stop 50 is provided to position and hold the cam 46 in place. As will be noted most particularly with reference to FIG. 1, the cam 46 when it is placed up against the cam stop 50 (as shown in phantom) is contacted by the rollers 34 in such a manner that the rollers 34 tend to force the cam 46 up against the cam stop 50 when the direction of rotation is as shown by the arrows. With the cam 46 slid along the slot 48 until it is stopped by the cam stop 50, the rollers 34 as they come upon the cam 46 are lifted by their shafts 38 which ride upon the top 52 of the cam 46 whereby the rollers 34 do not, during passage by the cam 46, force fluid through the tube 12. Thereby, a highly pulsating flow is provided.

Figure 3:
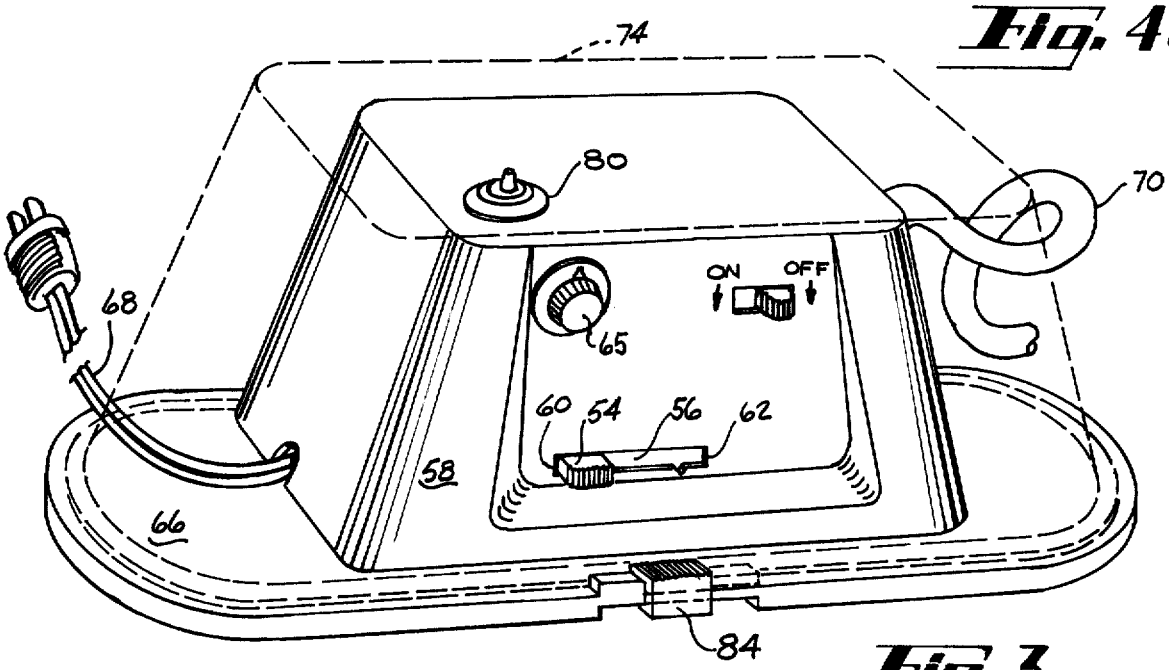
FIG. 3 illustrates the pump of the present invention within a housing therefor and a combined cover-reservoir (in phantom) which forms a part thereof.
Figure 5:
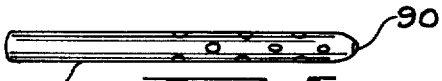
FIG. 5 illustrates a nozzle useful with the pump of the present invention.

Referring now most particularly to FIG. 3, it will be noted that a knob 54 which extends from the cam 46 rides within a slot 56 in the housing 58. The slot 56 includes a first recess 60 at the one end thereof wherein the cam 46 is out of place and away from the tube 12 and a second recess 62 wherein the cam is in place adjacent the tube. The recesses 60 and 62 serve in the preferred embodiment of the invention to fix the cam 46 in one of its two positions. Transfer from one of the two positions to the other is effected by simply pushing upwardly upon the knob 54 and sliding it through the slot 56 to the desired recess 60 or 62.

Reference once again to FIG. 1 will illustrate that the ends 36 and 42 of the levers 30 meet at the pivots 32 at an obtuse angle, 0, said obtuse angle opening generally towards the rotational axis 17 (or center 16) of the disc 14. This aids in providing a very steady flow through the tubing 12. Further, when one of the shafts 38 is riding upon the top 52 of the cam 46, the spring 40 is stretched less than it would be if the ends 36 and 42 of the levers 30 did not meet at the obtuse angle, 0, but instead were straight.

The pump 10 preferably includes an adjustable valve 64 adjacent the input port 19. The adjustable valve allows control of the total volume of water being propelled by the pump 10, via use of the control knob 65. Thus, the pump of the invention allows not only smooth flow or pulsating flow of fluid but also allows a complete selection of the volume of fluid being flowed either smoothly or pulsatingly.

Figure 4C:
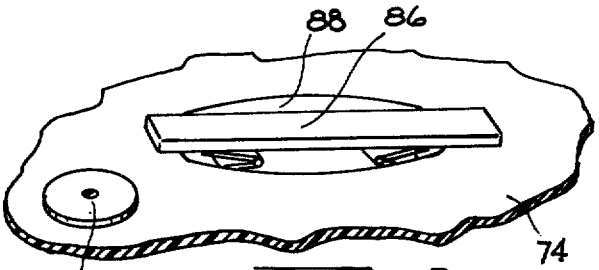
FIGS. 4*a*, 4*b* and 4*c* illustrate the combined cover-reservoir and details in the structure thereof.
Figure 4B:
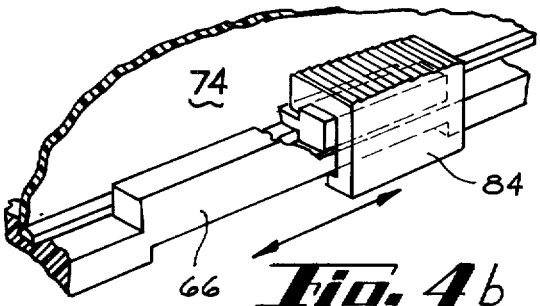
Figure 4A:
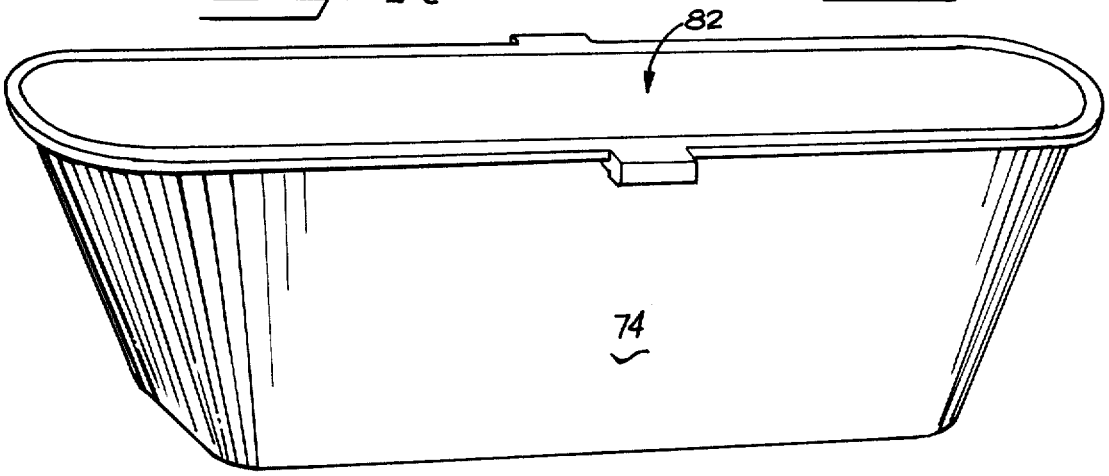

Referring most particularly to FIGS. 3 and 4, there is illustrated the housing 58 for the pump 10 which housing includes a base portion 66 which is useful for storage of an electric cord 68 and of coiled tubing 70 and of a nozzle or nozzles 72. A case 74 is provided which is adapted to be placed with its open end 76 upward to act as a reservoir for fluid and which includes means, namely the fluid port 78 adapted to mateably fit over the water inlet 80 for connecting the interior 82 of the case with the valve 64. The case 74 is further adapted to be placed with its open end 76 downward and to act as a cover for the pump 10 and the housing 58. A pair of latches 84 are provided adjacent the open end 76 of the case 74 for latchably engaging with the base portion 66 of the housing 58. The case 74 in the preferred embodiment of the invention includes a handle 86 which is recessible thereagainst. As illustrated most clearly perhaps in FIG. 4c the handle 86 is placed over a small recess 88 into which the user' s fingers can be slipped to grasp the handle 86. In the usual manner the handle 86 when pulled upon lifts away from the case 74 for easy carrying thereof. When the case 74 is latched to the base portion 66 of the housing 58 as via the latches 84 and with the electric cord 68, the coiled tubing 70 and the nozzle 72 upon the base portion 66 of the housing 58, a compact and portable unit results which is carryable by the collapsible handle 86.

The nozzle 72 generally communicates with the fluid exit port 22 via the flexible tubing 70. The nozzle 72 preferably includes a plurality of holes therein through which fluid propelled by the pump can exit. For effective use as a douche pump, it is preferred that the nozzle 72 include an end hole 90 therein as one of said plurality of holes.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A peristaltic action pump useful for douche and enema purposes and capable of delivering a uniform flow of liquid, comprising:

a flexible tube affixed in a hemicircular shape and having a fluid input port at one end thereof and a fluid exit port at the other end thereof;

a rotatable member adjacent said tube and generally parallel to the plane of said hemicircle, said rotatable member being rotatable about an axis in line with the axis of said hemicircle;

means coupled with said rotatable member for rotatingly driving it;

a pair of levers pivotally mounted intermediate thereof to said member, each at an equal and non-zero distance from the rotational axis of said member, a line from the mounting of one of said pair of levers to the mounting of the other of said pair of levers passing through said rotational axis of said member;

a pair of rollers, one of said rollers being pivotally attached to one of the ends of each of said levers, at least one of said pair of rollers including a shaft extending from the pivotal axis thereof and beyond said tube, said rollers extending sufficiently from said one end of said lever to press upon and temporarily deform said flexible tube, a line from the attachment of one of said pair of rollers to the attachment of the other of said pair of rollers passing generally through said rotational axis of said member;

a pair of pins, said pins being upraised from said rotatable members sufficiently to stop said levers from rotating about their pivotal mounting beyond said pins, said pins being further removed from the rotational axis of said member then are said levers, said pins being located generally intermediate the pivotal mounting of said levers and the rollers mounted to the one end of each of said levers;

spring means between the other ends of said pair of levers biasing said other ends of said pair of levers towards one another, a line from said other end of one of said levers to said other end of the other of said levers passing generally through said rotational axis;

a cam fixable in place adjacent said tube on an opposite side of said tube from said rotatable member, said shaft of each of said rollers extending sufficiently so as to ride upon said cam when fixed in place, said cam serving to keep one of said rollers from pressing upon and temporarily deforming said flexible tube during a portion of said rollers rotation about the rotational axis of said member whereby a pulsating flow of fluid can be selected by fixing said cam in place;

means for fixing said cam in place adjacent said tube; and means for fixing said cam out of place away from said shaft.

2. A pump as in claim 1, wherein the ends of each of said levers meet at the pivotal mounting of each of said levers at an obtuse angle, said obtuse angle generally opening towards the rotational axis of said member.

3. A pump as in claim 2, including an adjustable valve at said fluid input port and a case adapted to be placed open end upward to act as a reservoir for fluid and including means for connecting the interior of said reservoir with said valve, said case being further adapted to be placed open end downward to act as a cover for said pump.

4. A pump as in claim 3, including a housing thereover and wherein said case includes a handle recessible thereagainst and means attached thereto for latching said case over said housing as said cover therefor, said pump thereby being carryable by said handle.

5. A pump as in claim 4, wherein said means for fixing said cam in place adjacent said tube and said means for fixing said cam out of place away from said tube comprise a slot through said housing including a first recess and a second recess and said cam includes a knob extending into said slot and fixable in one of said first and said second recesses.

6. A pump as in claim 5, including a nozzle communicating with said fluid exit port, said nozzle including a plurality of holes therein through which fluid propelled by said pump can exit.

* * * * *